US005645344A

United States Patent [19]

Wijbenga

[11] Patent Number: 5,645,344

[45] **Date of Patent: *Jul. 8, 1997**

[54] LUMINAIRE

[75] Inventor: Hendrik Wijbenga, Eindhoven, Netherlands

[73] Assignee: U.S. Philips Corporation, New York, N.Y.

[ * ] Notice: The term of this patent shall not extend beyond the expiration date of Pat. No. 5,544,030.

[21] Appl. No.: 610,686

[22] Filed: Mar. 4, 1996

Related U.S. Application Data

[62] Division of Ser. No. 305,115, Sep. 13, 1994, Pat. No. 5,544,030.

[30] Foreign Application Priority Data

| | | | |
|---|---|---|---|
| Sep. 13, 1993 | [BE] | Belgium | 09300958 |
| Mar. 11, 1994 | [EP] | European Pat. Off. | 92400635 |

[51] Int. Cl.[6] ..... F21V 7/12

[52] U.S. Cl. ..... 362/346; 362/297; 362/304; 362/348

[58] Field of Search ..... 362/296, 297, 362/346, 350, 348, 217, 304, 349, 307, 223, 347

[56] References Cited

U.S. PATENT DOCUMENTS

| | | | |
|---|---|---|---|
| 4,021,659 | 5/1977 | Wiley . | |
| 4,087,682 | 5/1978 | Kolodziegj | 362/297 |
| 4,447,865 | 5/1984 | Van Horn et al. | 362/305 |
| 4,855,886 | 8/1989 | Eijkelenboom et al. | 362/350 |
| 4,905,133 | 2/1990 | Mayer et al. | 362/346 |
| 4,929,863 | 5/1990 | Verbeek et al. | 313/113 |
| 4,994,948 | 2/1991 | Cooch | 362/346 |
| 5,278,744 | 1/1994 | Geboers et al. | 362/348 |

*Primary Examiner*—Ira S. Lazarus
*Assistant Examiner*—Thomas M. Sember
*Attorney, Agent, or Firm*—Walter M. Egbert, III

[57] ABSTRACT

The luminaire has a concave reflector (1) built up from plane facets (4). The facets are arranged in rows (7) which extend between first parallel planes (8) towards the light emission window (3). The facets are also bounded by second parallel planes (9). The first and the second parallel planes extend parallel to the axis (2) of the reflector, but transversely to one another. A lamp holder (30) is present for holding an electric light source (31') in a plane transverse to the plane of symmetry (6) of the reflector. The luminaire is suitable for concentrating the light generated by the light source into a comparatively wide beam and for illuminating a field from a small distance with a high degree of homogeneity.

21 Claims, 15 Drawing Sheets

LUMINAIRE

This is a division of application Ser. No. 08/305,115, filed on Sep. 13, 1994 now U.S. Pat. No. 5,544,030.

BACKGROUND OF THE INVENTION

The invention relates to a luminaire comprising:

a concave reflector having an optical axis, an optical centre on said axis, a light emission window, and a reflecting surface which surrounds the optical axis, is built up from plane facets, and has a plane of symmetry, which facets are arranged in rows which each extend to the light emission window between first planes, and in addition are bounded by second planes which are substantially parallel to one another and transverse to the first planes;

means for accommodating an electric light source inside the reflector in a plane transverse to the plane of symmetry and in the optical centre.

Such a luminaire is known from U.S. Pat. No. 4,929,863. The known luminaire is rotationally symmetrical and suitable for forming a narrow beam from the light generated by an electric lamp with a comparatively short light source. The luminaire may thus be used for illuminating buildings with a height of 100 m or more, such as towers. The known luminaire may also be used for lighting large areas, such as sports stadiums, in that luminaires are positioned along the circumference. Because of the narrow beam, the laminaires do have to be placed on comparatively high masts of, for example, 50 m or more.

The plane facets in the known luminaire are arranged not only in rows which extend to the light emission window while being bounded by first planes, but also in continuous circumferential bands which are bounded by parallel second planes which are perpendicular to the axis of the reflector.

It is a limitation of the known luminaire that only a small portion of an object positioned at a comparatively small distance from the luminaire can be illuminated owing to the narrowness of the beam, and only with a very high local illuminance, too high for many applications.

SUMMARY OF THE INVENTION

It is an object of the invention to provide a luminaire of the kind described in the opening paragraph which is compact and suitable for providing a homogeneous and comparatively wide light beam.

According to the invention, this object is achieved in that the first planes are mutually substantially parallel and substantially parallel to the plane of symmetry, and the second planes are substantially parallel to the optical axis.

The luminaire forms a comparatively wide homogeneous beam of the order of 30° to 45° in directions transverse to the plane of symmetry, also called "horizontal directions" hereinafter. This width is twice to three times as large as the width in the plane of symmetry, also called "vertical direction" hereinafter. When the luminaire is fitted with a lamp having a light source of high power, for example 1500–2000 W, it will as a result be highly suitable for illuminating areas such as sports grounds, such as, for example, (soccer) football grounds and racecourses, from masts of comparatively small height, for example 25 to 35 m. However, when a reflector of a given dimension has comparatively few comparatively large facets, it can be used in conjunction with a light source of the same power for the same application at a smaller height of, for example, 15 to 25 m. Alternatively, however, the luminaire may accommodate a light source of lower power such as, for example, 400 to 1000 W, and be used from smaller heights of, for example, 10 to 20 m for interior lighting, for example, for lighting indoor sports halls for various applications. Light sources of comparatively low power, such as 100 W or less, may also be used in a luminaire of dimensions adapted to this light source. The luminaire may then be used, for example, for indoor lighting, for example in halls or rooms, for example office rooms.

It is an advantage of the luminaire according to the invention that a given individual luminaire is capable of accommodating a very wide range of light sources of widely differing dimensions of the light source transverse to the plane of symmetry without the beam-forming properties being substantially impaired. On the other hand, a light source may be used in luminaires of different dimensions.

In contrast to the known luminaire, whose reflector resembles a spider's web owing to its facets when viewed axially, the reflector of the luminaire according to the invention, when viewed axially, displays a pattern of substantially rectangular planes, except at the light emission window. In contrast to the known reflector, the first planes are not radial but parallel to one another and also parallel to the plane of symmetry, while the second planes are not perpendicular to, but parallel to the optical axis.

The reflector has points of intersection with the second planes in the plane of symmetry. In a favourable embodiment, these points of intersection lie on a curve having an axis and a focus in the optical centre, for example, on a parabola. The points of intersection may then lie at a first side of the optical axis on a first curve, for example on a branch of a first parabola, and at the other side of the optical axis on a second curve different from the first, for example on a branch of another parabola, for example a parabola having a focus and a greater focal distance, said focus coinciding substantially with the optical centre. That portion of the reflector will then give a wider beam. Those skilled in the art may readily adapt the luminaire to the envisaged application through the choice of the curve(s) during design.

At a first side of the optical axis, the points of intersection may lie on a first curve, for example a parabola branch, whose axis encloses an acute angle with the axis of the reflector, and possibly at the other side of the optical axis on a second curve whose axis encloses an acute angle of opposite sign with the axis of the reflector. The width of the beam in mainly vertical direction can be adjusted thereby and the beam may be made asymmetrical.

A favourable property of the luminaire is that double reflections in the luminaire are avoided to a high degree. The luminaire has a high efficiency as a result of this.

It is favourable when the reflector axis intersects a facet at an acute angle in the plane of symmetry, and at fight angles in a plane transverse to the plane of symmetry. It is counteracted thereby that the reflector throws back radiation onto the electric lamp. This enhances the reflector efficiency still further. Alternatively, the reflector axis may lie in a second plane so that there is no facet which is intersected by the axis, the axis on the contrary being tangent to two facets. The axis may also lie in a first plane, so that it is tangent to four facets.

In an embodiment of the luminaire having central facets, i.e. facets which are intersected by the plane of symmetry, said central facets may have a dimension transverse to said plane which is equal to or greater than the length of the light source to be accommodated. Such facets may give the light emission window an oval basic shape. Alternatively, the light emission window may have a round basic shape, also in the presence of such central facets.

In an alternative embodiment of the luminaire, the reflector has no central facets. The reflector axis then lies in a first plane.

The reflector may have smaller facets locally, for example in a central region intersected by the axis, than elsewhere, for example around this region. The reflector then has an additional plane, in this region, for example an additional second plane, which does not extend outside this region. Smaller facets in a central region have the result that the light beam formed by the reflector from the light of the lamp has a higher centre value than without these smaller facets.

In a special embodiment, the reflector has, in a plane through the axis transverse to the plane of symmetry, points of intersection with the first planes which lie on a curve which has a focus substantially in the optical centre, for example on a parabola. The light intensity distribution has a comparatively wide peak region in horizontal planes in this embodiment.

The points of intersection in said plane transverse to the plane of symmetry may, however, be located on two parabola branches which each with their focal point are laterally moved away from the plane of symmetry. Thereby, the reflector can be made wide enough to accommodate a light source which would otherwise not fit into the reflector.

It is also possible that the points of intersection in said plane transverse to the plane of symmetry are located on two parabola branches having a different focal distance. It is thereby achieved that the reflector generates a light beam which is asymmetric in horizontal directions.

In a favourable embodiment, the facets adjacent the light emission window in the plane of symmetry just cover an angle $\beta$ measured with the optical centre as the vertex, while the remaining facets in this plane just cover an angle $\beta\pm10\%$. In a modification thereof, the facets adjacent the light emission window in the plane through the optical axis and perpendicular to the plane of symmetry just cover an angle $\gamma$ with the optical centre as the vertex, while the remaining facets in this plane just cover an angle $\gamma\pm10\%$. The advantage of this embodiment and its modification is that the luminous flux increases in the top portion of the beam formed by the luminaire. The "top portion of the beam" is here understood to mean: all the light radiated at smaller angles to the optical axis than the angle at which half the maximum luminous flux is radiated. A favourable result of this is that fewer luminaires are required for illuminating a given field, or luminaires fitted with lamps of lower power. Another result is that less light is radiated at comparatively great angles to the axis, which light could be unpleasant or dazzling. It is favourable when the facets all cover an identical or substantially identical angle in the plane of symmetry. It is equally favourable when the facets cover an identical or substantially identical angle in the plane through the axis and perpendicular to the plane of symmetry. The values of $\beta$ and $\gamma$ vary with the chosen number of facets in the reflector.

The luminaire may be used, for example, in a position in which the plane of symmetry is vertical. It is favourable then to limit the emission of unreflected light above the reflector axis by means of a screen mounted above the axis in the reflector. This screen is positioned transversely to the plane of symmetry, at a distance from the optical axis. It may be light-absorbing at its side facing away from the axis and reflecting at its side facing the axis. Depending on the inclination of the reflector, the screen may even substantially prevent radiation above the horizontal plane.

The luminaire may accommodate an electric discharge lamp, for example a high-pressure discharge lamp with, for example, rare gas, mercury and metal halides, in which the light source is a discharge path between electrodes, but alternatively an incandescent lamp such as, for example, a halogen incandescent lamp, in which the light source is a filament. The lamp may be entirely inside the reflector. It is favourable, however, to have the lamp project through the reflector, so that the free ends of its current supply conductors are in a comparatively cold spot outside the reflector where they are less subject to corrosion. The efficiency may also benefit from this because in this case the means for accommodating the light source inside the reflector, such as a lampholder, cannot intercept light.

The reflector may be separable in the plane transverse to the plane of symmetry in which the lamp can be accommodated. This facilitates lamp insertion.

The reflector may be accommodated in a housing which may be closed off with a glass plate. Alternatively, however, the reflector itself may be, or may be a portion of, the outside of the luminaire.

It is also possible for an electric light source to be permanently incorporated in the means for accommodating a light source inside the reflector. The photometric properties of the luminaire in fact remain unaffected thereby.

BRIEF DESCRIPTION OF THE DRAWINGS

Embodiments of the luminaire according to the invention are shown in the drawing, in which.

DESCRIPTION OF THE PREFERRED EMBODIMENTS

Figure 1:
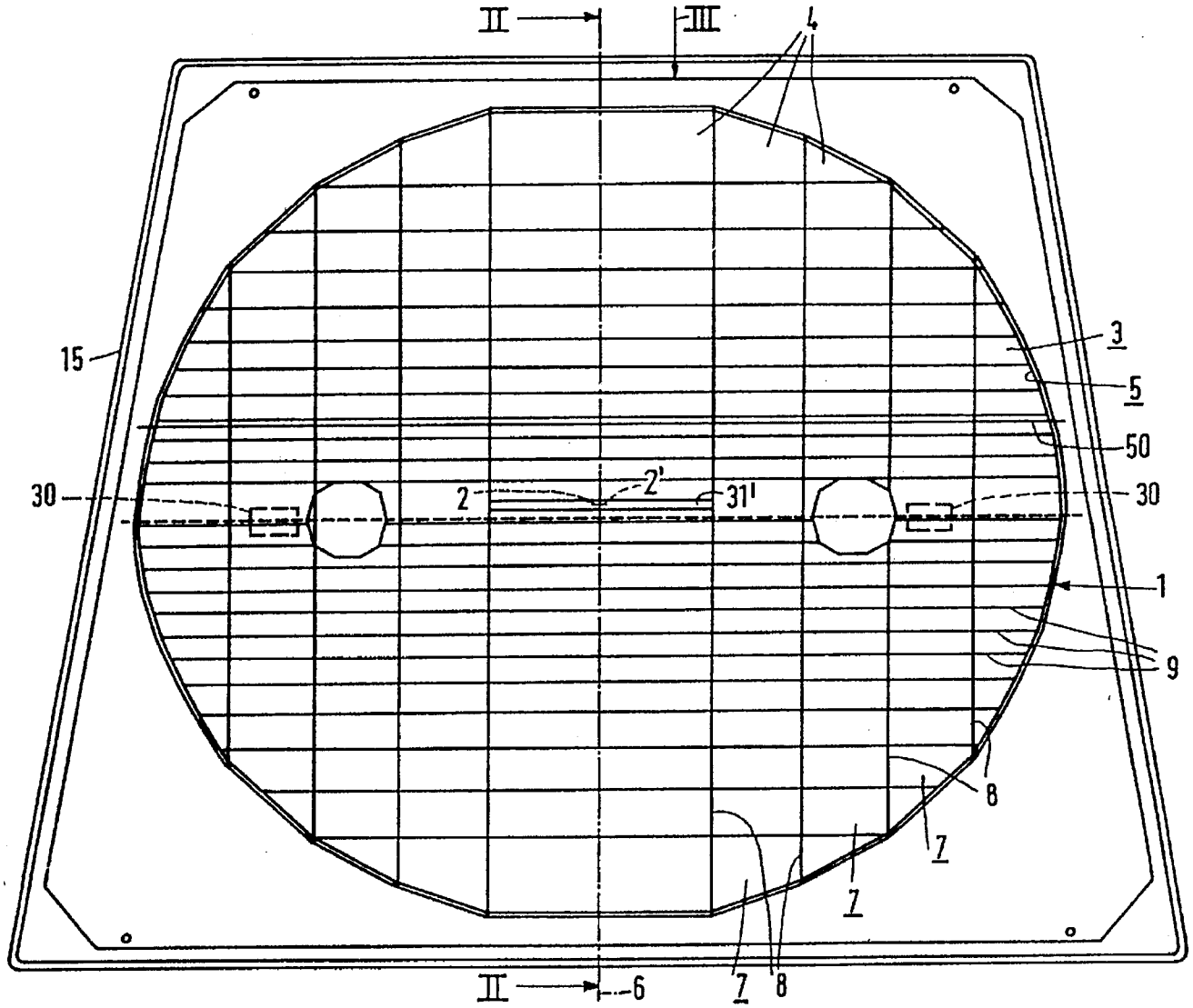
FIG. 1 shows a first embodiment in axial view.
Figure 2:
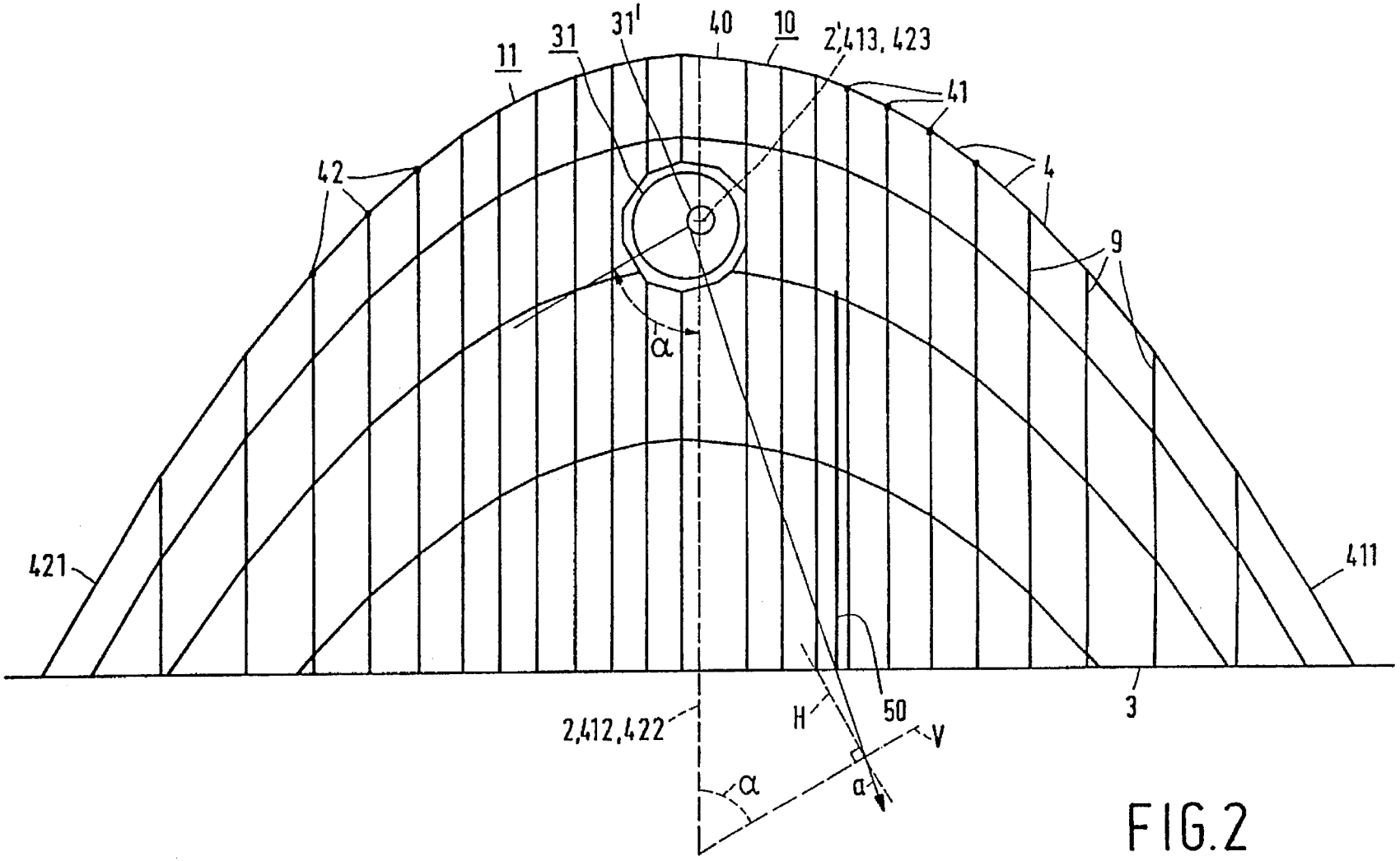
FIG. 2 is a cross-section of the reflector taken on II—II in FIG. 1.
Figure 3:
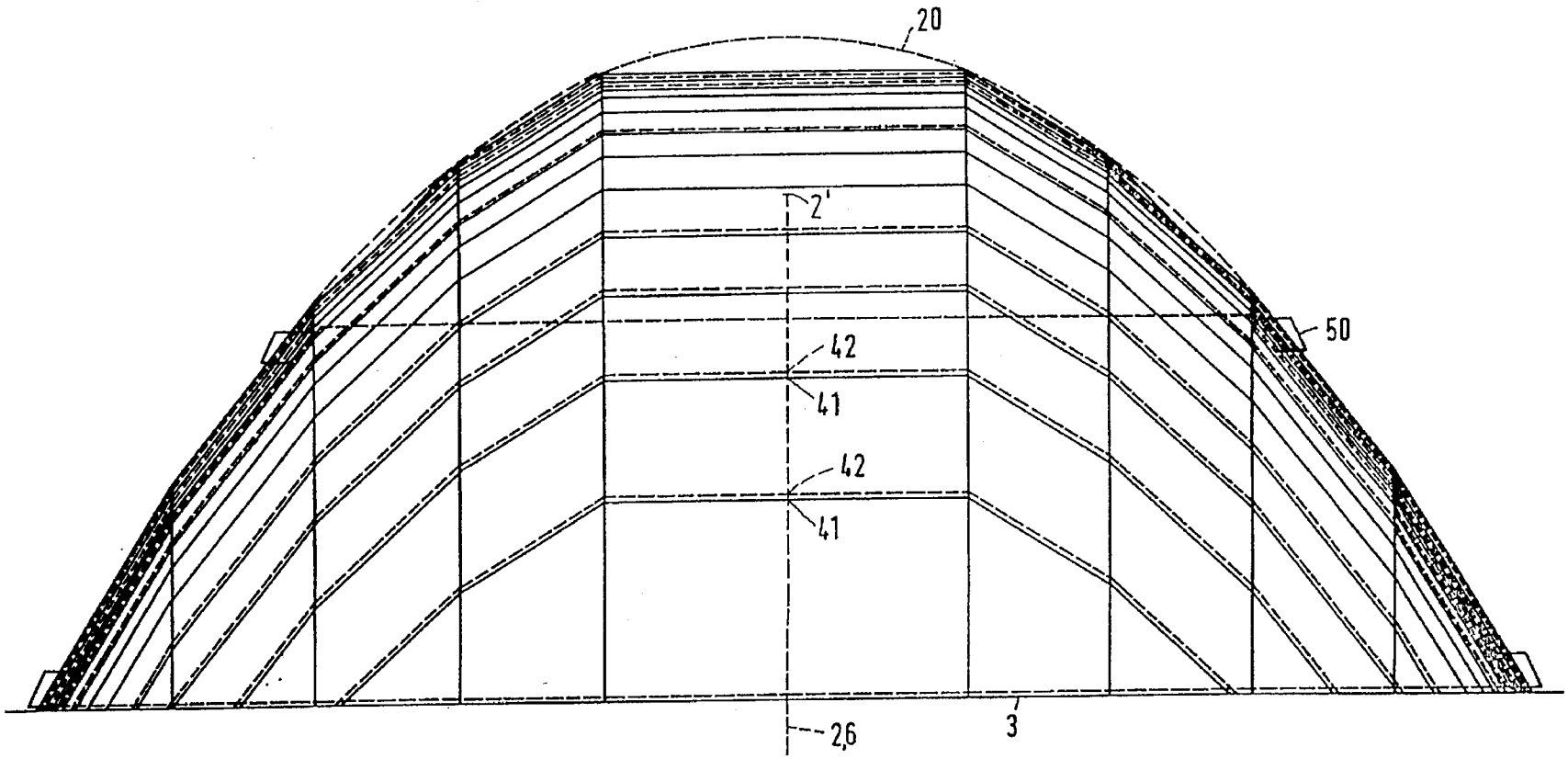
FIG. 3 is a plan view of the reflector according to III in FIG. 1.

The luminaire of FIGS. 1, 2 and 3 comprises a concave reflector 1 with an optical axis 2, an optical centre 2' on the axis, a light emission window 3 and a reflecting surface 5 surrounding the optical axis, built up from plane facets 4 and having a plane of symmetry 6. The facets are arranged in rows 7 which each extend between first planes 8 towards the light emission window 3. The facets are also bounded by second planes 9 which are mutually substantially parallel and transverse to the first planes 8.

The luminaire comprises means 30 for holding an electric light source 31' inside the reflector in a plane transverse to the plane of symmetry 6 and in the optical centre 2'. In the embodiment drawn, these means are formed by two lampholders which can each accommodate a lamp cap of a double-capped electric lamp. Alternative embodiments, however, may be designed for the use of a single-capped lamp.

The first planes 8 are mutually substantially parallel, and substantially parallel to the plane of symmetry 6. The second planes 9 are substantially parallel to the optical axis 2. The luminaire drawn has a housing 15. The light emission window 3 in the embodiment shown has an oval basic shape with its greatest diameter transverse to the plane of symmetry.

In the plane of symmetry 6, the reflector 1 has points of intersection 41 (FIG. 2) with the second planes 9. These points lie on a curve 411 having an axis 412 and a focus 413 which coincides substantially with the optical centre 2' of the reflector. This curve is not drawn in the Figure since it would run very closely alongside the facets given the scale used and would render the drawing less clear.

In the plane of symmetry 6 (FIG. 2) at a first side 10 of the optical axis 2, the reflector 1 has points of intersection 41 with the second planes 9, which points lie on a first curve 411, in the Figure on a branch of a parabola with $y^2=4*50.5x$, and at the other side 11 of the optical axis 2 points of intersection 42 with the second planes 9, which points lie on a second curve 421 with an axis 422 and a focus 423 different from the first curve 411. The second curve in the Figure is a branch of a parabola with $y^2=4*51.5x$. The focus coincides substantially with the optical centre.

The axis 2 of the reflector 1 intersects a facet 40 at an acute angle in the plane of symmetry 6 (FIG. 2) and at fight angles in a plane transverse to the plane of symmetry (FIG. 3).

The drawn reflector 1 is tangent to a parabola 20, in the Figure with $y^2=4*62.5x$, in a plane through the axis 2 and transverse to the plane of symmetry 6 (FIG. 3). In the embodiment shown, the focuses of the parabolas coincide or substantially coincide.

Within the circle in FIG. 2 which indicates the contours of the electric high-pressure discharge lamp 31 to be accommodated, a smaller circle 31' is shown which represents the light source of the lamp, i.e. the discharge are. This are is shifted away from the centre of the lamp 31 owing to convection flows during operation. The Figure shows the position of the are when the axis 2 encloses an angle $\alpha$ of 65° with the vertical V. The are 31' is then perpendicularly above the centreline (not shown) of the lamp 31. The are thus passes through the optical centre. Said angle $\gamma$ is the average of the inclination angles for which the luminaire drawn was designed. For illumination of a field immediately below the suspension point of the luminaire, a smaller angle $\alpha$ will be set, and a greater one for a field further removed. Light my a is the ray with the highest direction which can leave the luminaire without previous reflection on the reflector, because a screen 50 is present in the reflector (see also FIGS. 1 and 3). The ray remains below the horizontal H in the envisaged operational position of the luminaire. As a result, the luminaire causes little or no stray light.

Figure 4:
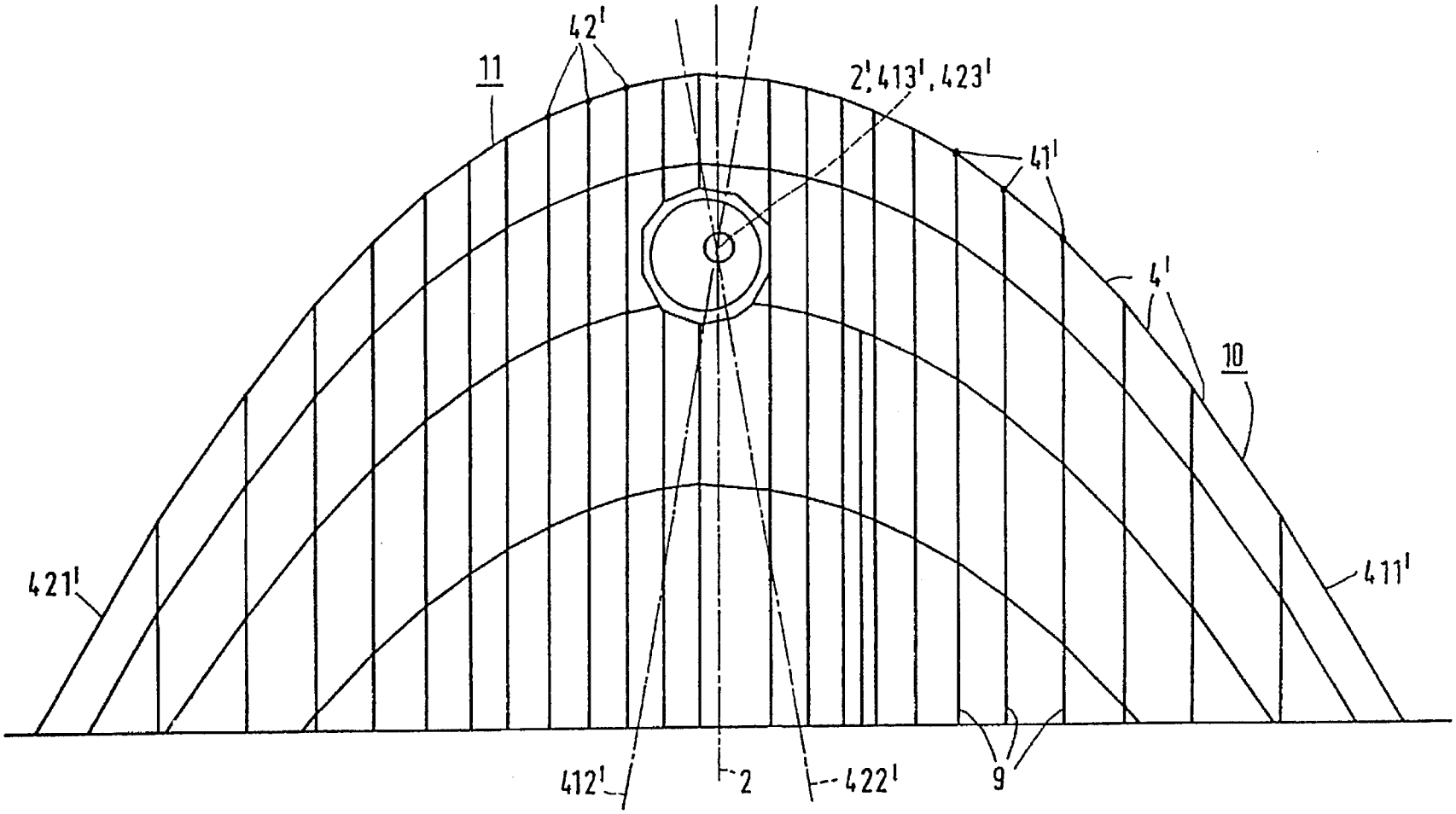
FIG. 4 is a cross-section as in FIG. 2 of an alternative embodiment.

In FIG. 4, the facets 4' in the plane of symmetry 6 at a first side 10 of the optical axis 2 have points of intersection 41' with the second planes 9, which points lie on a first curve 411'. The axis 412' thereof encloses an acute angle with the axis 2 of the reflector 1. The facets 4' at the other side 11 of the optical axis have points of intersection 42' with the second planes 9, which points lie on a second curve 421' whose axis 422' encloses an acute angle of opposite sign with the axis 2 of the reflector.

The focuses 413', 423' substantially coincide in the optical centre 2'.

Figure 5:
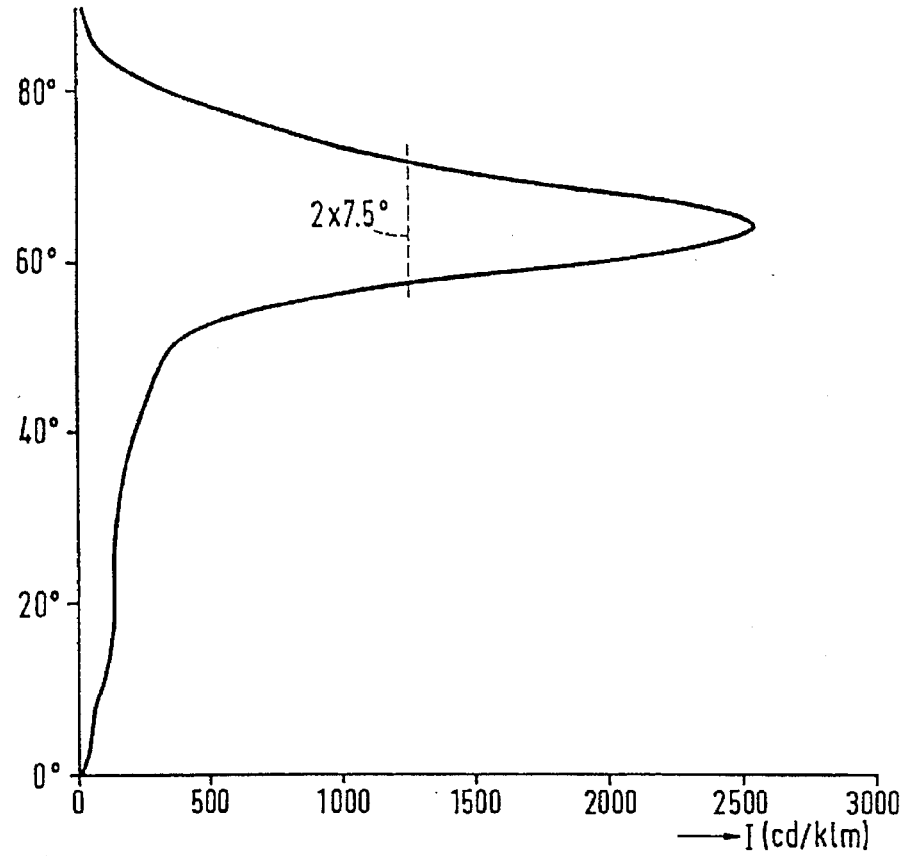
FIG. 5 is the light distribution diagram of the first embodiment, measured in the plane of FIG. 2.
Figure 6:
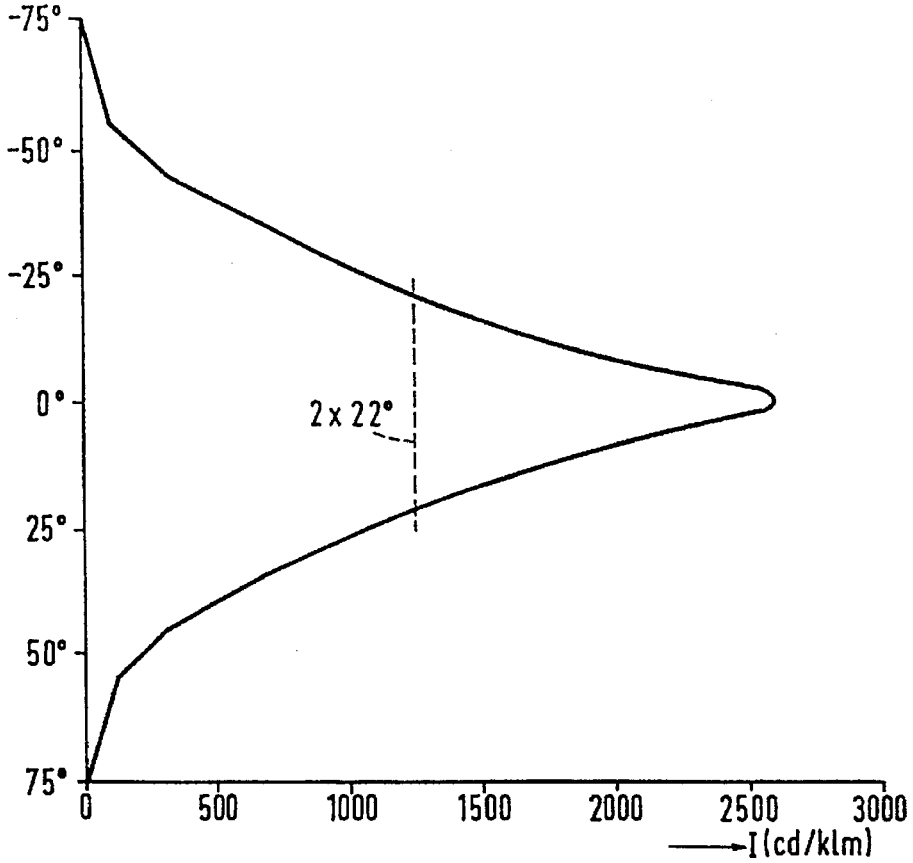
FIG. 6 is the light distribution diagram of the first embodiment measured in a plane through the axis 2 and perpendicular to the plane of FIG. 2.

The luminaire of FIGS. 1–3 was used with a 2 kW metal halide discharge lamp with a discharge are of 110 mm length, i.e. a length corresponding to the width of the facets through the plane of symmetry. FIGS. 5 and 6 show the measured distribution of the light intensity of the luminaire. FIG. 5 shows that the maximum light intensity is obtained at an angle of 65° to the vertical. Substantially no light is emitted horizontally (90° to the vertical). The distribution is symmetrical up to the smaller angles to the vertical, where the screen 50 (FIG. 2) adds light to the beam which would otherwise be lost to the given application, ground illumination, because it would be radiated upwards. The screen may be omitted in the application for, for example, the illumination of wide buildings of small height. The beam has a width of 2°×7.5° in the vertical plane at the area of half its maximum intensity.

FIG. 6 shows the light intensity distribution in the horizontal plane through the axis of the luminaire. The horizontal beam width is 2°×22°, three times that of the vertical.

A field of 68×105 $m^2$ was illuminated from four masts of 32 m height, each mast carrying ten luminaires as shown in FIGS. 1–3, each containing a 2 kW metal halide lamp and provided with a front plate with wire mesh. The illumination values of Table 1 were obtained in that the luminaires were aimed at different positions.

TABLE 1

| $\bar{E}$(lx) | $E_{min}/E_{max}$ | $E_{min}/\bar{E}$ |
|---|---|---|
| 420 | 0.85 | 0.94 |
| 460 | 0.67 | 0.8 |
| 480 | 0.55 | 0.72 |

In the Table, $\bar{E}$ is the average, $E_{max}$ the maximum, and $E_{min}$ the minimum illuminance.

The Table shows that a high average illuminance $\bar{E}$ of 420 lux is obtained with a very high homogeneity: high ratios in the second and the third column. Even a 10% higher illuminance $\bar{E}$ of 460 1× can be realised with a homogeneity which is very acceptable in practice. The third row of numbers in the Table shows how great the flexibility is in the design of a lighting installation in which the luminaire according to the invention is used. Even at a 15% higher average illuminance than the first one a reasonable homogeneity is still achieved which satisfies the recommendations valid internationally for sports grounds.

The luminaire shown has a high efficiency of 80% in spite of the use of a front plate with metal wire mesh. The reflector was made from specularly reflecting anodized aluminum with a reflectivity of 0.86, i.e. 86% of the incident light is reflected. The light loss owing to absorption by the reflector in this luminaire is 9% of the generated light. Reflections and absorption caused by the front plate leads to a light loss of approximately 8% of the quantity of incident light. Furthermore, the wire mesh accounts for approximately 4.5% loss of the light issuing through the front plate. This clearly shows that, since the luminaire efficiency is 80%, multiple reflections inside the luminaire, which would give additional losses, are avoided to a high degree.

Figure 7:
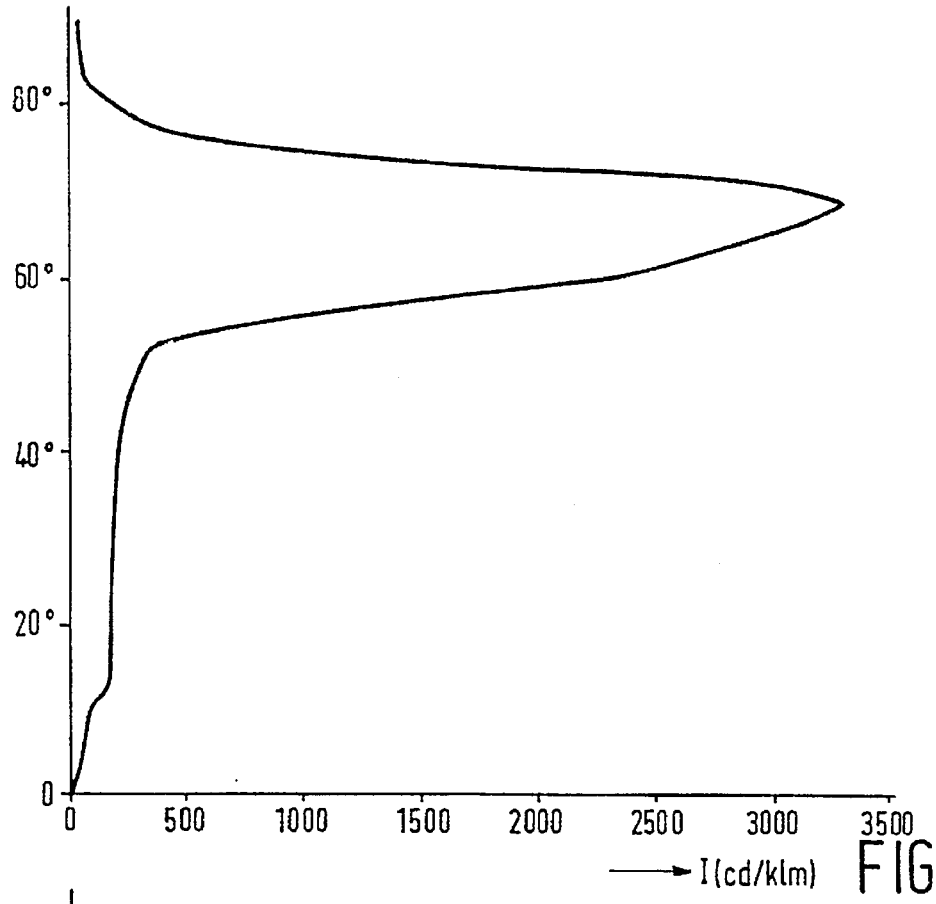
FIG. 7 is the light distribution diagram of the first embodiment with a different light source, measured in the plane of FIG. 2.
Figure 8:
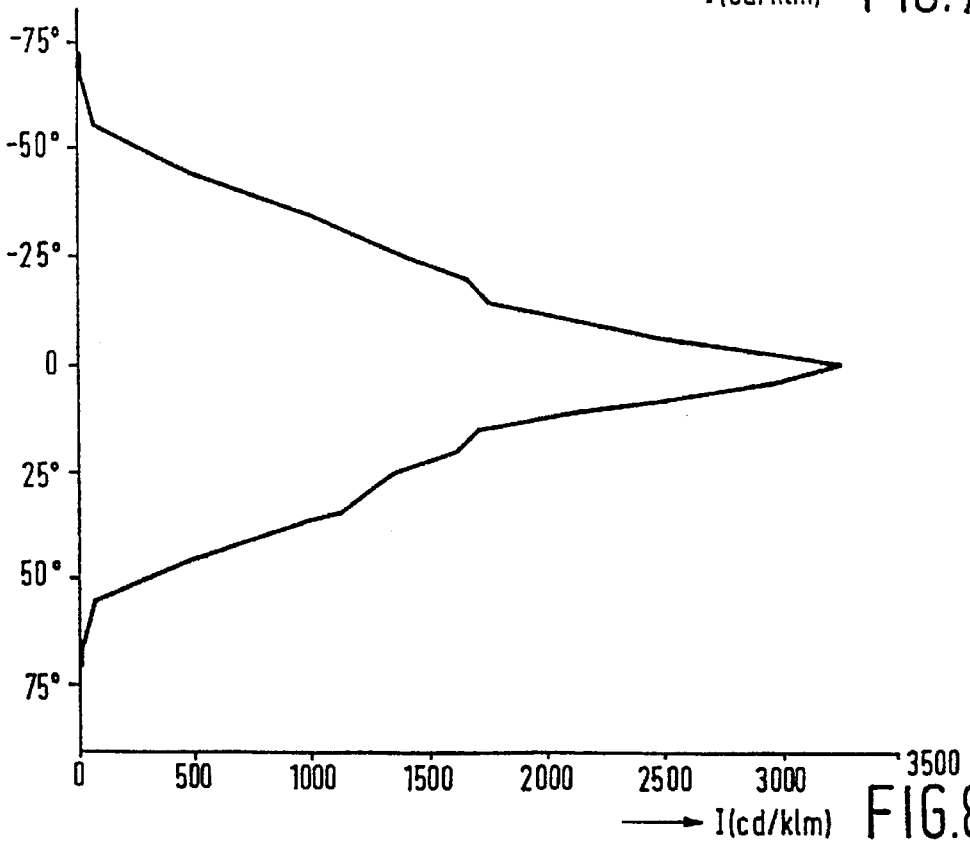
FIG. 8 is the light distribution diagram of the first embodiment with the same light source as in FIG. 7, measured in a plane through the axis 2 and perpendicular to the plane of FIG. 2.

The light distributions of FIGS. 7 and 8 were obtained with an 1800 W discharge lamp having an are of 25 mm length as the light source, i.e. a length corresponding to less than one quarter the width of the facets through the plane of symmetry. The vertical beam width is 2°×8°, the horizontal beam width 2°×21°. The efficiency of the luminaire is 80% again, also with this light source which is much shorter than the former one.

The horizontal beam width obtained with this light source of small horizontal dimension compared with the horizontal beam width in the same reflector obtained with the said much longer light source with a horizontal dimension of 110 mm illustrates the light-spreading effect of the plane facets. A relative enlargement of the facets relative to the light source leads to a widening of the beam.

Figure 9:
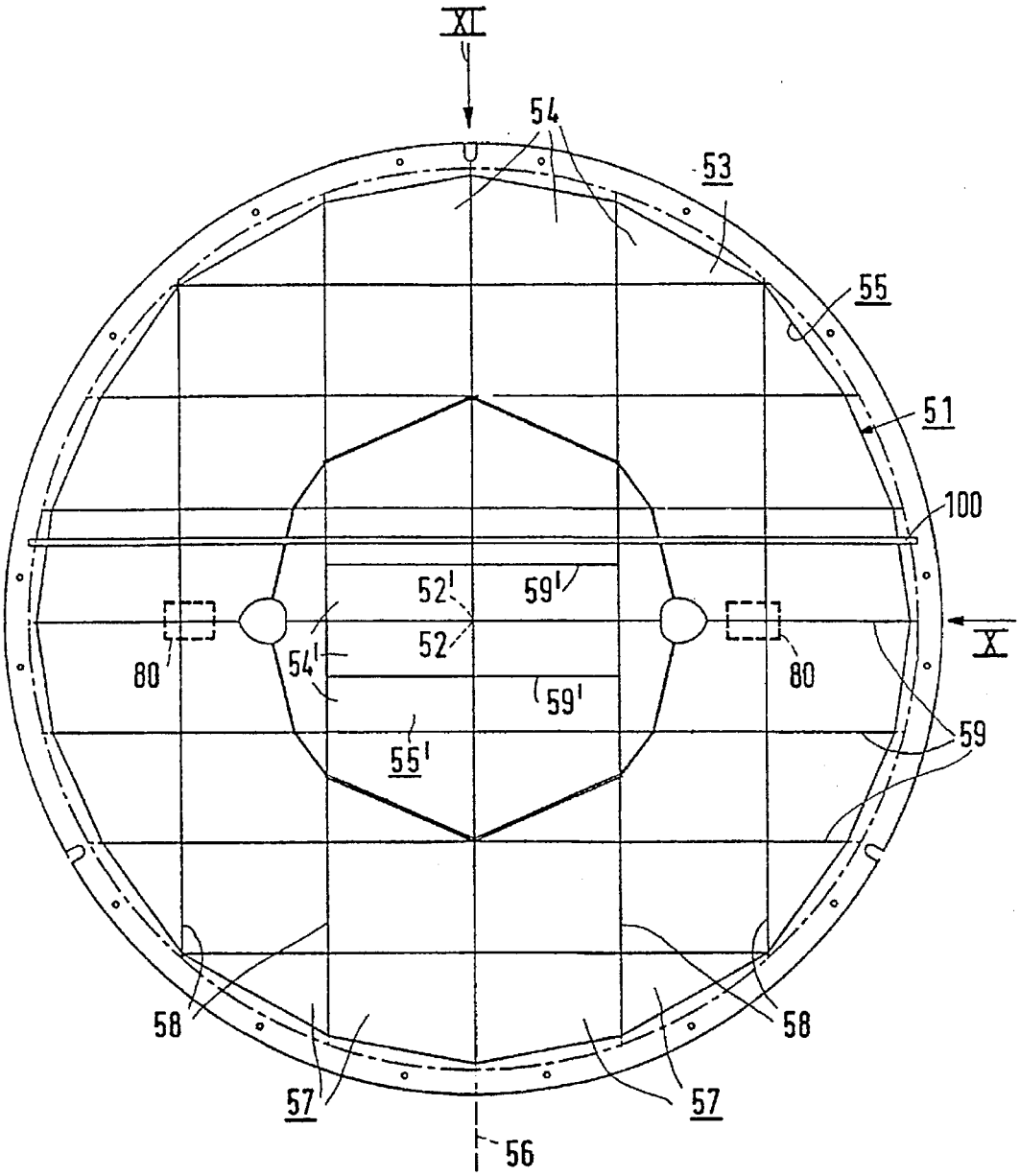
FIG. 9 is an axial elevation of a further embodiment of the reflector.
Figure 10:
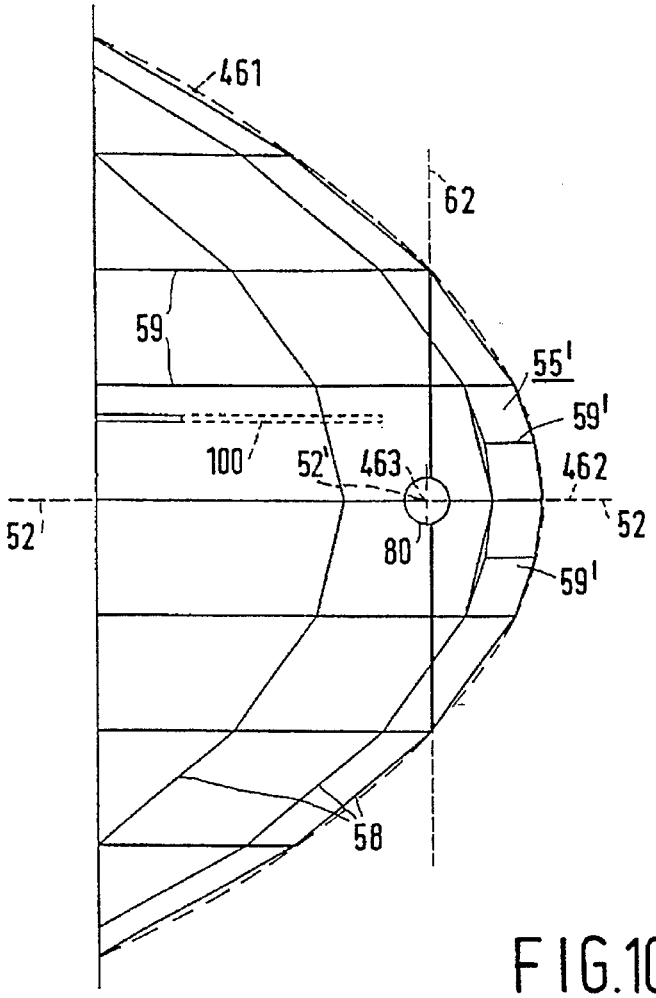
FIGS. 10 and 11 are elevations taken on X and XI in FIG. 9.
Figure 11:
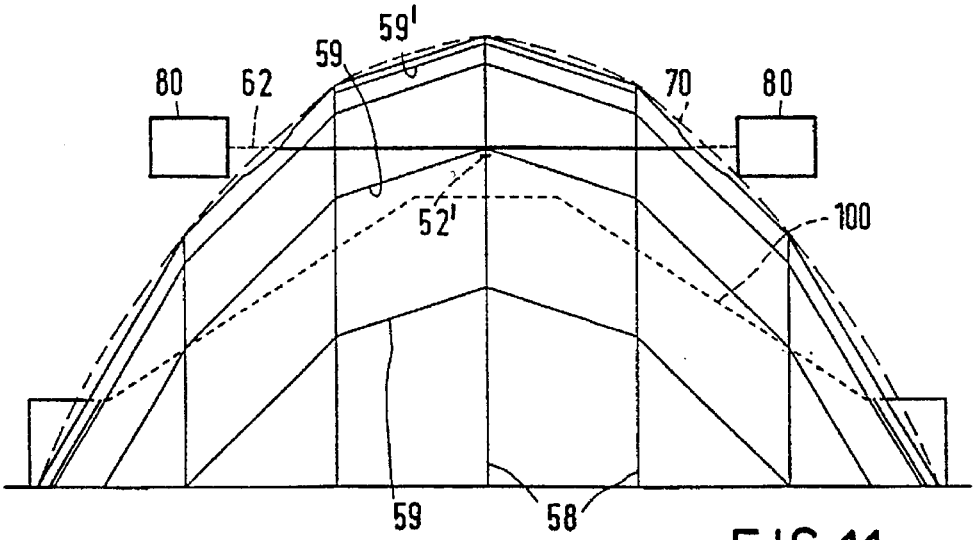

In FIGS. 9, 10 and 11, parts of the reflector 51 corresponding to parts in FIGS. 1, 2 and 3 have reference numerals which are 50 higher than in the latter Figures.

The optical axis 52 of this reflector lies in a second plane 59, so that there is no facet which is intersected perpendicularly by the axis, and also in a first plane 58. As a result, there are four facets tangent to the axis. Within a region 55' intersected by the optical axis, the reflector shown has additional planes, in the Figure two additional planes 59', which each extend over two rows 57. Smaller facets 54' have been formed thereby.

The reflector is separable in the plane 62 transverse to the plane of symmetry 56 in which the lamp can be accommodated. The light emission window 53 of the reflector is of substantially equal width in directions transverse and thus has a sand thus has a substantially round basic shape.

In the plane of symmetry 56, the reflector 51 is tangent to a parabola 461 with an axis 462 and a focus 463 in the optical centre 52', and in a plane through the axis 52 and transverse to the plane of symmetry to a curve, in the FIG. a parabola 70, with a focus which coincides substantially with the optical centre.

Figure 12:
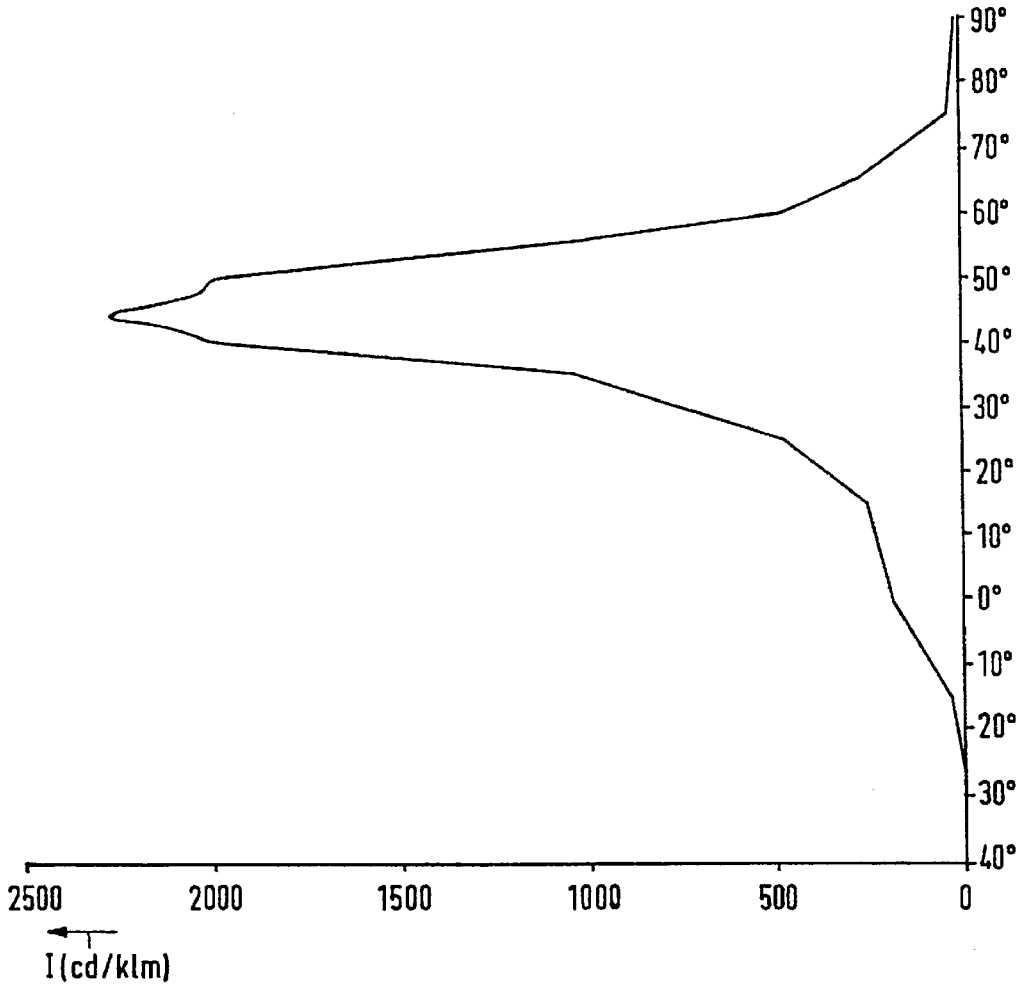
FIG. 12 is the light distribution diagram in the plane of drawing of FIG. 10.
Figure 13:
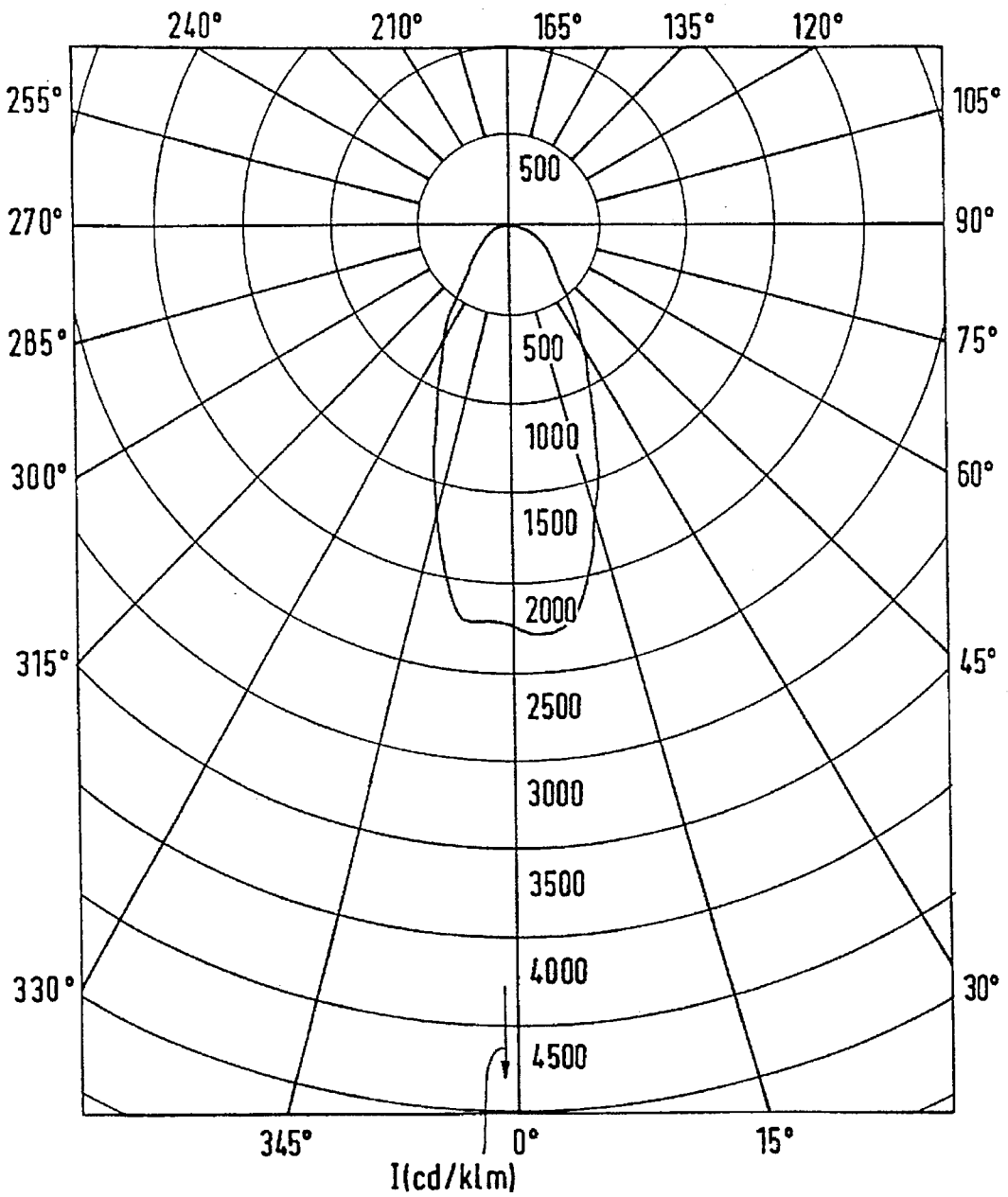
FIG. 13 is the light distribution diagram in the plane of drawing of FIG. 11.
Figure 14:
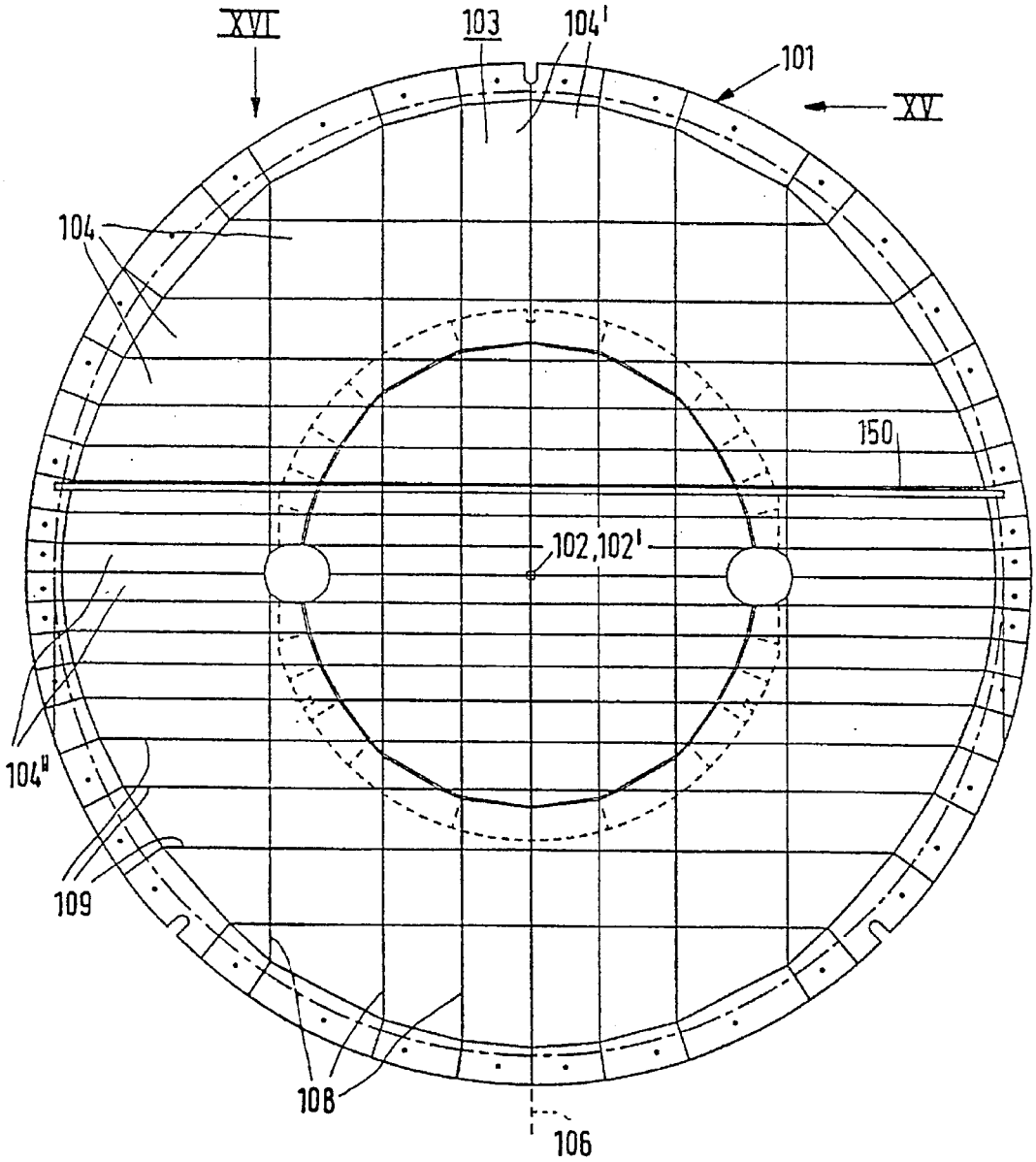
FIG. 14 is an axial elevation of a further embodiment of a reflector.

A high-pressure discharge lamp with a discharge are of 25 mm length was accommodated in a luminaire provided with the reflector 51 with a screen 100 present therein. The lamp consumed a power of 1775 W. The light distribution of the light beam formed by the luminaire was measured with the luminaire enclosing an angle of 45° with the vertical. It is apparent from FIG. 12 that the beam has a width of 18.5° in the plane of symmetry, and from FIG. 13 that it has a width of 45° in the plane through the axis and perpendicular to the plane of symmetry.

The luminaire has an efficiency of 80%.

A 250 W high-pressure discharge lamp with a discharge arc of 27 mm length was used in a luminaire which was only 0.7 times the size of the former luminaire and a light emission window of only 28 cm in diameter. The luminaire created a light beam containing 80% of the light generated by this lamp with its comparatively great arc length.

Figure 15:
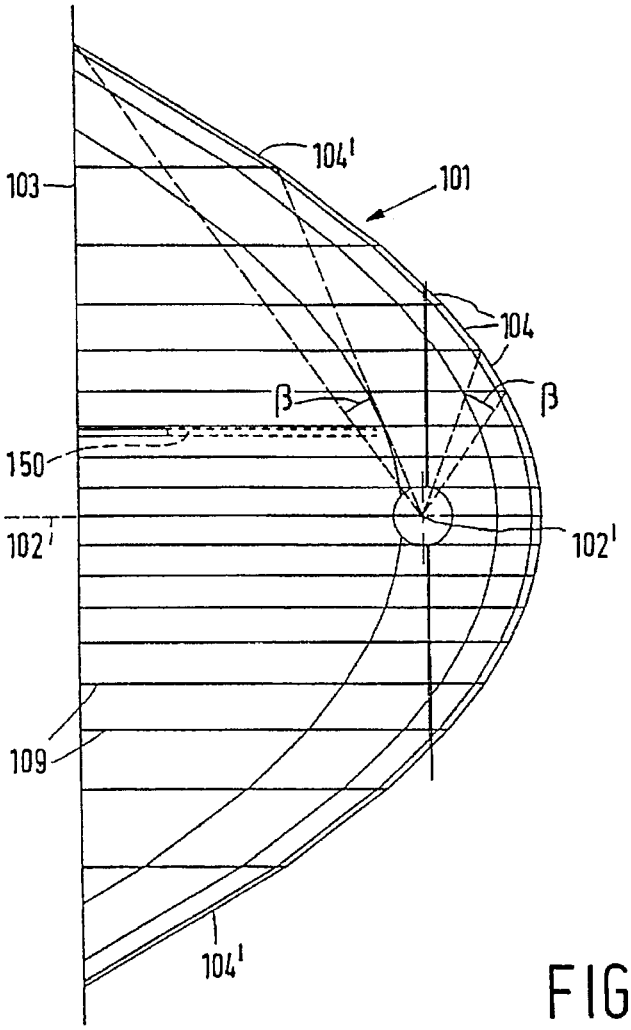
FIGS. 15 and 16 are side elevations taken on XV and XVI in FIG. 14.
Figure 16:
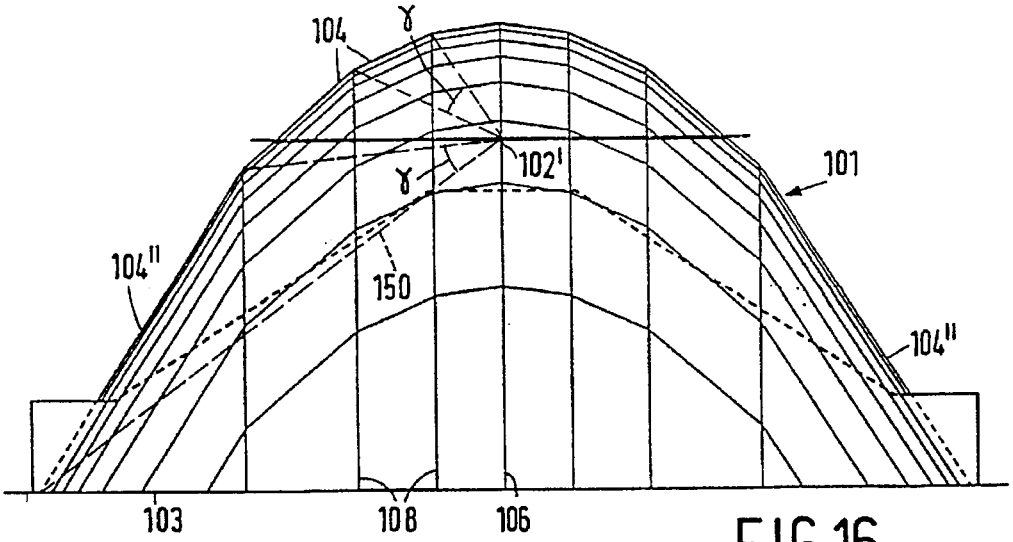
Figure 17:
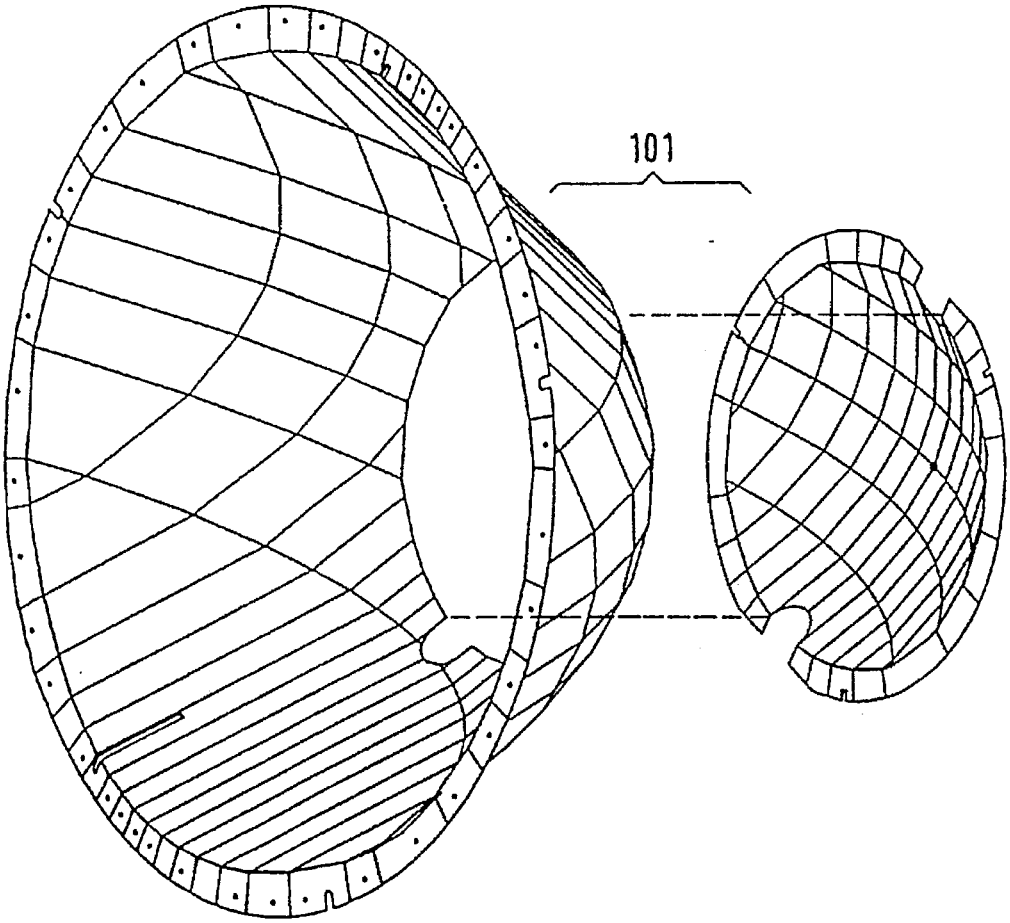
FIG. 17 shows the reflector of FIG. 14 in perspective view.

In FIGS. 14–17, components corresponding to those of FIG. 1 have reference numerals which are 100 higher. The luminaire reflector shown has facets 104' adjacent the light emission window 103 in the plane of symmetry 106. The reflector has facets 104" adjacent the light emission window 103 in the plane through the axis 102 and perpendicular to the plane of symmetry 106. The remaining facets of the reflector have been referenced 104. In the plane of symmetry 106, as is the case in FIG. 10, the reflector is tangent to a parabola whose focus lies in the optical centre 102' (FIG. 15). The reflector is also tangent to a parabola in the plane through the axis 102 and perpendicular to the plane of symmetry (FIG. 16), as is the reflector of FIG. 11, which parabola has its focus in the optical centre.

The facets 104' (FIG. 15) just cover an angle β with a vertex in the optical centre 102'. The other facets 104 in this plane just cover an angle β±10% , in the FIG. exactly the angle β.

The facets 104" (FIG. 16) just cover an angle γ with a vertex in the optical centre 102', the other facets 104 in this plane just an angle γ±10%. In the Figure, these facets again just cover the angle γ.

Figure 18:
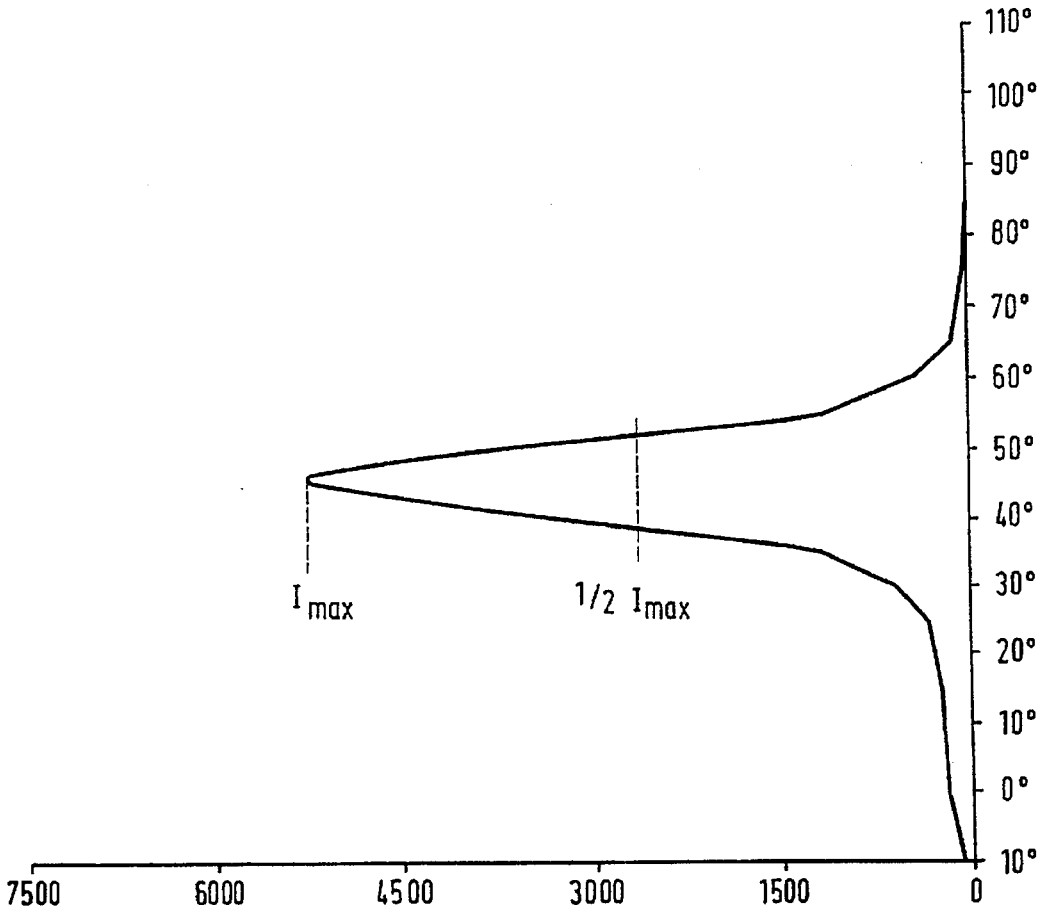
FIGS. 18 and 19 are light distribution diagrams obtained with a lamp in the reflector of FIG. 14, in the plane of FIG. 15 and of FIG. 16, respectively.
Figure 19:
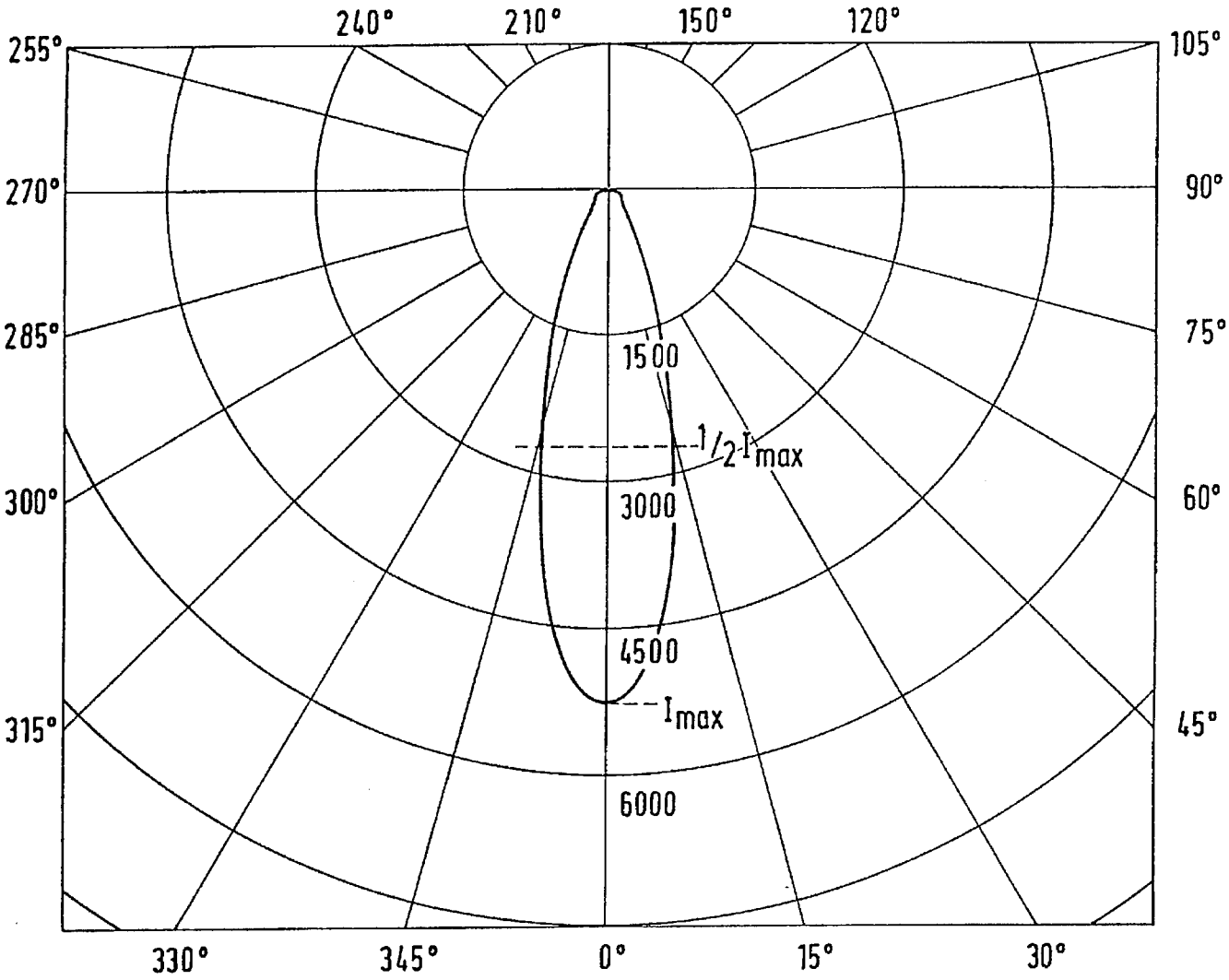

A luminaire with this reflector was provided with the high-pressure discharge lamp mentioned above with a discharge are of 25 mm and a power of 1775 W. The luminaire was closed off with a glass plate with a metal wire grating. The light distribution in the beam generated by the lamp and the luminaire is shown in FIGS. 18 and 19, the luminaire being pointed downwards with its optical axis at an angle of 45° to the perpendicular.

In the plane of symmetry (FIG. 18), the vertical plane, the beam has a maximum luminous intensity $I_{max}$ of 5260 cd/klm for a half-value width, i.e. the angle between the directions in which 0.5 $I_{max}$ is emitted, of 13.6°, the vertex being in the optical centre. The flanks of the curve are steep and the base is low, higher in the case of the smaller angles than in the case of the greater angles owing to the presence of the screen 150 whereby the field to be illuminated receives extra light which would otherwise be lost for useful purposes. The low luminous intensity at greater angles demonstrates the low glare risk. The beam has a width of 30° in the plane through the axis and perpendicular to the plane of symmetry. Apart from the effect of the screen 150, the beam has a high degree of symmetry. The efficiency of the luminaire is 80%.

I claim:

1. A reflector for a light source, comprising:

a body having a concave reflecting surface having an optical axis, a plane of symmetry and a light emission window, said reflecting surface surrounding the optical axis and comprising a plurality of plane facets, said plane facets being arranged in rows between first planes and bounded by second planes which are substantially parallel to one another and transverse to the first planes, the first planes being mutually substantially parallel and substantially parallel to the plane of symmetry, and the second planes being substantially parallel to the optical axis.

2. A reflector as claimed in claim 1, characterized in that in the plane of symmetry the reflector has points of intersection with the second planes, which points lie on a curve having an axis and a focus, which focus lies in the optical center.

3. A reflector as claimed in claim 2, characterized in that the reflector has first and second opposing sides defined by the optical axis, said reflecting surface has on the optical axis on the optical center, at said first side of the optical axis the points of intersection lie on a first curve having a first axis and a first focus, and at the second side of the optical axis the points of intersection lie on a second curve with a second axis and a second focus, the second curve being different from the first curve, and said first and second foci coinciding substantially with the optical center.

4. A reflector as claimed in claim 2, characterized in that said reflecting surface has a said facet intersected by said optical axis (i) at an acute angle in the plane of symmetry and (ii) at right angles in a plane transverse to the plane of symmetry.

5. A reflector as claimed in claim 2, characterized in that in a plane through the optical axis and perpendicular to the plane of symmetry, the reflector is tangent to a curve which has a focus which coincides substantially with the optical center.

6. A reflector as claimed in claim 5, characterized in that the facets adjacent the light emission window in the plane through the axis and perpendicular to the plane of symmetry just cover an angle $\gamma$ with a vertex in the optical center, while the other said facets in said plane just cover an angle $\gamma\pm10\%$.

7. A reflector as claimed in claim 2, characterized in that the optical axis lies in a said second plane.

8. A reflector as claimed in claim 7, characterized in that the optical axis lies in a said first plane.

9. A reflector as claimed in claim 2, characterized in that the reflecting surface has a central region adjacent the optical axis with an additional plane defining additional facets.

10. A reflector as claimed in claim 2, characterized in that some of said facets are adjacent the light emission window in the plane of symmetry just cover an angle $\beta$ with a vertex in the optical center, while the other of said facets in said plane just cover and angle $\beta\pm10\%$.

11. A reflector as claimed in claims 10, characterized in that some of said facets are adjacent the light emission window in a plane through the optical axis and perpendicular to the plane of symmetry and just cover an angle $\gamma\pm10\%$.

12. A reflector as claimed in claim 2, characterized in that the reflector is separable in the plane transverse to the plane of symmetry in which the lamp can be accommodated in said lamp holder means.

13. A reflector as claimed in claim 1, characterized in that a screen is arranged transversely to the plane of symmetry at a distance from the optical axis for restricting emission of unreflected light out of the light emission window.

14. A reflector as claimed in claim 1, characterized in that the reflector has a facet intersected by said optical axis (i) at an acute angle in the plane of symmetry and (ii) at right angles in a plane transverse to the plane of symmetry.

15. A reflector as claimed in claim 1, characterized in that in a plane through the optical axis and perpendicular to the plane of symmetry the reflector is tangent to a curve which has a focus which coincides substantially with the optical center.

16. A reflector as claimed in claim 1, characterized in that the optical axis lies in a said second plane.

17. A reflector as claimed in claim 1, characterized in that the optical axis lies in a said first plane.

18. A reflector as claimed in claim 1, characterized in that the optical axis lies in a said first plane.

19. A reflector as claimed in claim 1, characterized in that the reflector has a central region adjacent the optical axis having an additional plane defining additional facets.

20. A reflector as claimed in claim 1, characterized in that the reflector is separable in the plane transverse to the plane of symmetry.

21. A reflector according to claim 1, wherein said reflecting surface has a central region immediately surrounding said optical axis having more facets per unit area than in other regions removed from said central region.

* * * * *